United States Patent [19]

Landgraf et al.

[11] 3,931,850

[45] Jan. 13, 1976

[54] APPARATUS FOR FEEDING AND DISTRIBUTING STEEL MELTS

[75] Inventors: Helmut Landgraf, Rumeln-Kaldenhausen; Herbert Forster, Dusseldorf, both of Germany

[73] Assignee: Mannesmann Aktiengesellschaft, Dusseldorf, Germany

[22] Filed: Jan. 23, 1975

[21] Appl. No.: 543,294

[30] Foreign Application Priority Data

Mar. 11, 1974 Germany ..... 2412053

[52] U.S. Cl. ..... 164/281; 164/82

[51] Int. Cl.[2] ..... B22D 11/10

[58] Field of Search ..... 164/82, 281

[56] References Cited

UNITED STATES PATENTS

| | | | |
|---|---|---|---|
| 3,371,704 | 3/1968 | Astrov et al. | 164/281 |
| 3,517,726 | 6/1970 | Mills et al. | 164/281 X |
| 3,536,122 | 10/1970 | Kloten et al. | 164/281 X |
| 3,587,719 | 6/1971 | Schrewe et al. | 164/281 |
| 3,888,294 | 6/1975 | Fastner et al. | 164/281 X |

FOREIGN PATENTS OR APPLICATIONS

| | | | |
|---|---|---|---|
| 2,015,033 | 10/1971 | Germany | 164/281 |

*Primary Examiner*—R. J. Shore

*Attorney, Agent, or Firm*—Cullen, Settle, Sloman & Cantor

[57] ABSTRACT

Apparatus for feeding and distributing a steel melt into a continuous casting mould for slabs includes a pouring vessel with outlet apertures in its bottom wall. Immersion outlet elements depend from said vessel in registry with its outlet apertures, and extend down through the bath surface level in the mould and have lateral outlets. A pair of immersion outlets extend into said mould, and have an internal cross-section greater than the apertures in the pouring vessel, with their bottoms closed. Said immersion outlets each have a pair of lateral outlets of different cross-sectional area, on opposite sides thereof, longitudinally offset with respect to each other. One of the outlet apertures is larger in cross section than the other and is directed towards the center of the mould. Smaller outlet apertures are one-third to one-fifth of the cross-sectional area of the larger outlet apertures. Said outlet apertures are directed obliquely upward.

10 Claims, 3 Drawing Figures

Fig. 1
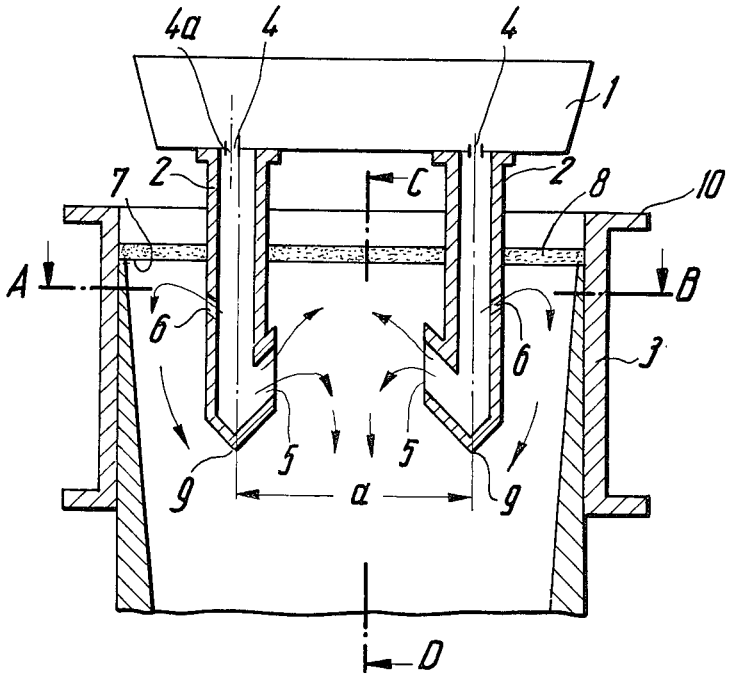
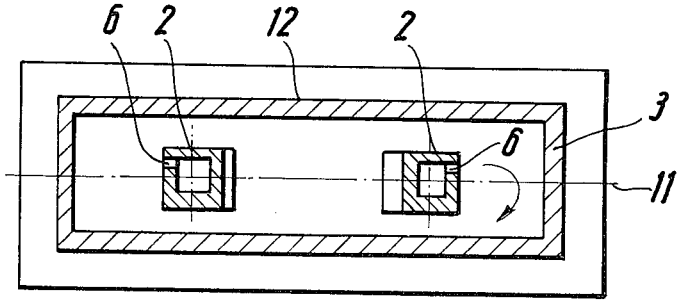
Fig. 2

APPARATUS FOR FEEDING AND DISTRIBUTING STEEL MELTS

BACKGROUND OF THE INVENTION

It is known to use outlet elements having a lateral outlet aperture for feeding melts in the production of continuous steel castings having an elongated rectangular form (Slabs). Usually, outlet elements of this kind are used in order on the one hand to improve the surface quality of the casting produced, and on the other hand to influence advantageously in addition the flow conditions of the steel flowing into the mould, in order to improve the degree of purity in the castings which are produced.

BRIEF DESCRIPTION OF THE INVENTION

The present invention has as its object to make a further improvement in the casting art when making liquid steel flow into a mould, with the aim of further reducing inclusions and at the same time improving the structure of the castings which are produced, more especially as regards reducing so-called internal cracks. In an apparatus for feeding and distributing a steel melt in a continuous casting mould for slabs, comprising a casting or pouring vessel with outlet apertures arranged in the bottom and immersion outlet element means arranged below these apertures and comprising lateral outflow apertures, therefore according to the invention it is proposed that below the outlet apertures of the pouring vessel two immersion outlet elements are provided for each slab mould, these preferably having a larger internal cross-section than the cross-section of the outlet apertures, the bottom ends of the said outlet elements being closed, that the immersion outlet elements comprise two outflow apertures of different cross-sectional size both of which are situated below the bath surface in the mould, that furthermore the outflow apertures are situated opposite one another in the walls of the immersion outlet elements but are arranged vertically offset relatively to one another, and the outflow apertures with the relatively large cross-sectional area form the lower outflow apertures and are directed towards the mould centre.

The direction of flow in the relatively large outflow apertures is directed obliquely upwards in a manner known per se.

According to a further feature of the invention the apparatus is characterised in that the cross-sectional area of the external relatively small outflow aperture amounts to one-third to one-fifth of the cross-sectional area of the internal outflow aperture. The direction of flow in the upper outflow apertures is preferably directed obliquely upwards, but may also be directed horizontally. This alignment is conveniently determined in accordance with practical requirements. It should be so selected that a slight movement of the bath surface is obtained. As regards the intended flow conditions it has been found that it is not particularly critical if the immersion outlet elements are arranged so that the longitudinal axes of these elements diverge relatively to the direction in which the continuous casting is drawn off. The angle between the casting draw-off direction and the axis of the immersion outlet elements can amount to 4° to 8°. With an inclined position of the immersion outlet elements, the axes of the outlet apertures of the distributing vessel and the axes of the immersion outlet elements also should not be in alignment with one another but should be offset so that the outlet aperture of the distributing vessel is situated between the axis of the immersion outlet element and that wall of the immersion outlet element which comprises the outflow aperture with the smaller cross-section.

According to a further feature of the invention the two immersion outlet elements for each mould are so arranged in the mould that the axes of the immersion outlet elements have a spacing of two-thirds of the mould width at the level of the upper edge of the mould.

In a further advantageous development of the invention it is proposed to arrange the outflow apertures with the relatively small cross-section in an eccentric situation in the immersion outlet, the outflow apertures being arranged relatively near to the centre point of curvature when using curved moulds.

The arrangement and construction of the two immersion outlet elements according to the invention achieve the result that the steel flowing out is made to change direction in a manner known per se at the casting surface. The horizontal components of the speed of flow of the two main streams, that is to say the streams issuing from the relatively large apertures, cancel one another out.

The bath surface in the edge region of the slabs between immersion outlet element and narrow mould side is moved and thus the formation of a top crust is obviated. The eccentric arrangement means that a vortex is produced on the casting surface. The small speed of flow is sufficient to avoid freezing and to obtain a generally central flow in the mould. In addition the steel of the secondary stream is drawn away from the edge at the lower end of the immersion outlet element, so that an additional separation of impurities is obtained which allows the degree of purity in this region to be improved.

The centre offset given to the feeding of the steel relatively to the longitudinal axis of the immersion outlet element influences the relationship of the mass flows of the main and secondary streams. The slightly inclined position of the immersion outlet elements is used for stabilising the flow conditions.

Converting the kinetic energy into a spinning movement makes it possible to annul it in a smaller space. The small flows produced in general in the mould region contribute to improving the structure, more particularly avoiding cracks.

The subject of the invention will be explained in detail with reference to a constructional example. In the drawings:

DETAILED DESCRIPTION

FIG. 1 shows a side view of the apparatus according to the invention,

FIG. 2 shows a plan view taken on the section line A–B in FIG. 1,

Figure 3:
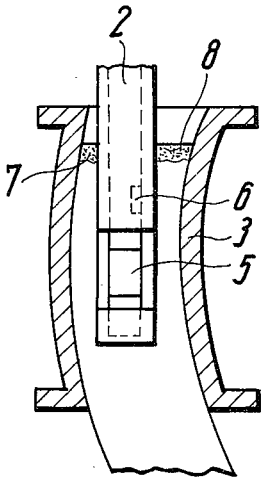
FIG. 3 shows a side view on the section line C–D in FIG. 1.

According to FIG. 1 a distributing vessel 1 is provided with two immersion outlet elements 2 for a slab mould 3. As shown at the right-hand half of the illustration, the immersion outlet elements 2 can be flange-connected centrally below the outlet apertures 4 of the distributing vessel 1. But as is shown in the left-hand half they may also be arranged in an eccentric situation relatively to the outlet aperture 4*a*. Each immersion outlet element 2 comprises two outflow apertures 5, 6. The outflow apertures 5, 6 are of different cross-sectional size and are situated below the bath surface 7 in the mould 3. 8 designates a per se known covering material situated on the casting surface 7. The outflow apertures 5 with relatively large cross-sectional areas are arranged close above the bottom of the immersion outlet elements 2. They are situated opposite one another within the general arrangement and are directed towards the centre of the mould. The outflow apertures 6 which have a relatively small cross-section are vertically offset relatively to the outflow apertures 5. The size of the said smaller-section outflow apertures amounts to one-third to one-fifth of the cross-sectional area of the outflow apertures 5. The spacing a of the axes 9 of the immersion outlet elements 2 amounts to about two-thirds of the width of the mould 3.

In FIG. 2 and FIG. 3 like parts are designated with the same reference numerals as in FIG. 1. It can be seen that the immersion outlet elements 2 within the curved mould 3 are arranged centrally relatively to the transverse axis 11 of the mould 3 at the level of the outlet apertures 5. The outflow apertures 6 with the realtively small cross-section are arranged eccentrically within the immersion outlet elements 2. These outflow apertures 6 are also situated at the side associated with the centre point 12 of the curvature of the curved mould.

Having described our invention, reference should now be had to the following claims.

We claim:

1. Apparatus for feeding and distributing a steel melt in a continuous casting mould for slabs, comprising a pouring vessel with outlet apertures arranged in its bottom portion and with immersion outlet elements which are arranged below the said apertures and include lateral outflow apertures, characterized in that below the outlet apertures (4) of the pouring vessel (I) there are arranged for each slab mould (3) a pair of immersion outlet elements (2) with a larger internal cross-section than the cross-section of the outlet apertures, the bottom ends of the said outlet elements being closed, each of said immersion outlet elements (2) having a pair of outflow apertures (5, 6) of different cross-sectional size, both situated below the bath surface level (7) in the mould (3), said outflow apertures (5, 6) being located opposite one another in the walls of the immersion outlet elements (2) but are offset relatively to one another in the vertical sense, and the outflow apertures (5) having the larger cross-section form the lower outflow apertures and are directed towards the center of the mould.

2. Apparatus according to claim 1, characterized in that the cross-sectional area of the external small outflow apertures (6) amounts to one-third to one-fifth of the cross-sectional area of the internal outflow apertures (5).

3. Apparatus according to claim 1, characterized in that the direction of flow in the larger-section outflow apertures (5) is directed obliquely upwards.

4. Apparatus according to claim 1, characterized in that the immersion outlet aperatures are so arranged that the longitudinal axes (9) thereof diverge relatively to the direction in which the casting is drawn off, at an angle ranging from 4° to 8°.

5. Apparatus according to claim 4, characterized in that the axes of the outlet apertures of the distributing vessel and the axes of the immersion outlet elements are out of alignment with one another and are offset in such a manner that the outlet aperture of the distributing vessel is situated between the axis of the immersion outlet element and that wall of the immersion outlet element which comprises the outflow aperture with the smaller cross-section.

6. Apparatus according to claim 1, characterized in that the axes (4) of the immersion outlet elements (2) at the level of the upper edge (10) of the mould are spaced two-thirds of the mould width.

7. Apparatus according to claim 1, said mould being curved, characterized in that the apertures of the immersion outlet elements (2) are arranged centrally in the mould (3) at the height of the outflow apertures (5).

8. Apparatus according to claim 1, characterized in that the outflow apertures (6) with the relatively small cross-section are arranged eccentrically in the immersion outlet element (2).

9. Apparatus according to claim 1, said mould being curved, characterized in that the outflow apertures (6) with the relatively small cross-section are arranged concentrically in the immersion outlet elements (2), towards the center of curvature (12).

10. Apparatus according to claim 3, characterized in that the direction of flow in the smaller-section outflow apertures (6) is directed obliquely upwards.

* * * * *